United States Patent [19]

Trosin

[11] Patent Number: 5,029,571

[45] Date of Patent: Jul. 9, 1991

[54] OVEN DOOR WINDOW UNIT

[75] Inventor: James R. Trosin, Waterford Township, Oakland County, Mich.

[73] Assignee: Mills Products, Inc., Farmington, Mich.

[21] Appl. No.: 571,292

[22] Filed: Aug. 23, 1990

[51] Int. Cl.[5] ..... F23M 7/00

[52] U.S. Cl. ..... 126/200; 52/790

[58] Field of Search ..... 126/200; 52/788, 790

[56] References Cited

U.S. PATENT DOCUMENTS

| | | | |
|---|---|---|---|
| 2,535,589 | 12/1950 | Mills . | |
| 2,551,755 | 5/1951 | Mills . | |
| 2,612,154 | 9/1952 | Mills . | |
| 2,710,994 | 6/1955 | Mills . | |
| 2,880,475 | 4/1959 | Mills . | |
| 3,021,832 | 2/1962 | Mills . | |
| 3,070,085 | 12/1962 | Mills . | |
| 3,127,890 | 4/1964 | Mills . | |
| 3,168,089 | 2/1965 | Larkin . | |
| 3,200,812 | 8/1965 | Larkin . | |
| 3,219,026 | 11/1965 | Larkin . | |
| 3,228,388 | 1/1966 | Mills . | |
| 3,418,779 | 12/1968 | Jendrisak et al. | 126/200 |
| 3,577,973 | 5/1971 | Katona . | |
| 3,664,326 | 5/1972 | Mills . | |
| 3,665,915 | 5/1972 | Katona . | |
| 4,023,554 | 5/1977 | Katona . | |
| 4,041,930 | 8/1977 | Katona . | |
| 4,043,091 | 8/1977 | Katona . | |
| 4,049,939 | 9/1977 | Katona . | |
| 4,206,338 | 6/1980 | Katona . | |
| 4,253,286 | 3/1981 | Katona . | |

*Primary Examiner*—Carroll B. Dority

*Attorney, Agent, or Firm*—Barnes, Kisselle, Raisch, Choate, Whittemore & Hulbert

[57] ABSTRACT

A window unit for an oven door having a pair of rectangular window panels held in spaced parallel relation by a frame. The frame is in the form of a one-piece strip of flexible, bendable material which extends about the periphery of the panels. The frame has clamping sections along the edges of the window panels to clamp the panels together. The clamping sections terminate short of the corners of the panels so that the corners are exposed and not subject to pressure and chipping by the frame. At the corners, the frame has spacers which extend between the panels to hold the panels spaced apart. The clamping sections and spacers are integral parts of the one-piece frame.

9 Claims, 2 Drawing Sheets

OVEN DOOR WINDOW UNIT

This invention relates generally to window units and refers more particularly to a window unit for an oven door.

BACKGROUND AND SUMMARY OF THE INVENTION

Typically the window unit of an oven door comprises at least two window panels held in laterally spaced parallel relation by a clamping frame and a spacer. In most cases, the clamping frame extends around the entire periphery of the window panels, including the corners thereof, and the spacer is an annular channel between the panels.

In the window unit of the present invention, the frame has clamping sections along the edges of the window panels which terminate short of the corners of the panels so that the corners are exposed and not subject to pressure and chipping from the outside frame. Adjacent the corners of the panels, the frame has spacers extending between the ends of the clamping sections to hold the panels apart.

In accordance with the specific construction about to be described, the frame is in the form of a one-piece strip of flexible, bendable material which extends about the periphery of the panels. The clamping sections and spacers are integral parts of the one-piece frame.

One of the objects of the invention is to provide a window unit having the foregoing features, and one which is relatively inexpensive and easy to manufacture, yet is rugged and dependable in use. Other objects, advantages and features of the invention will become more apparent as the following description proceeds, especially when considered with the accompanying drawings.

DETAILED DESCRIPTION

Figure 1:
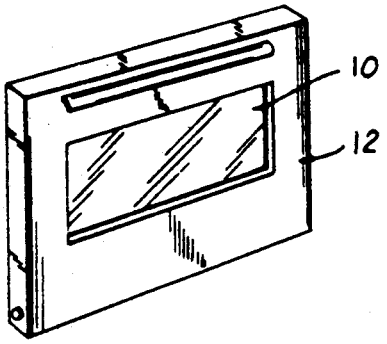
FIG. 1 is a perspective of an oven door having a window unit constructed in accordance with this invention.
Figure 2:
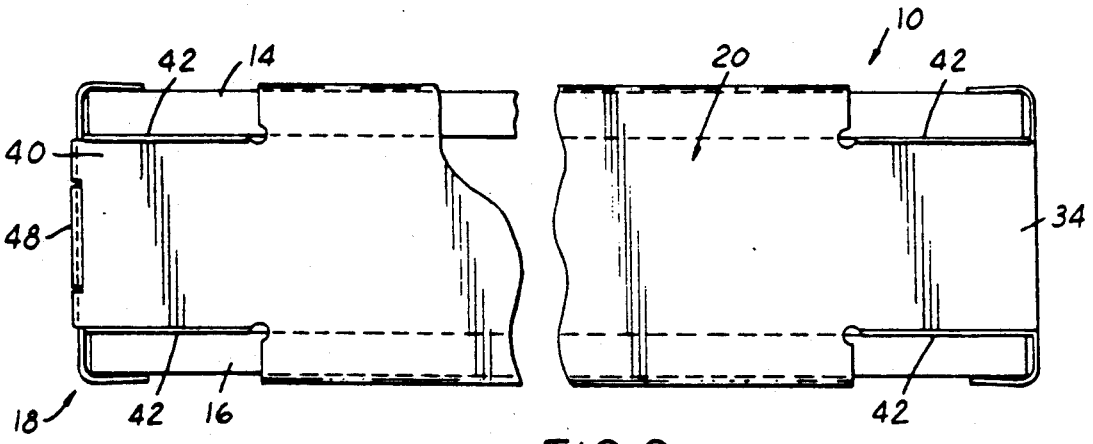
FIG. 2 is a top edge view with parts broken away of the window unit of this invention.
Figure 3:
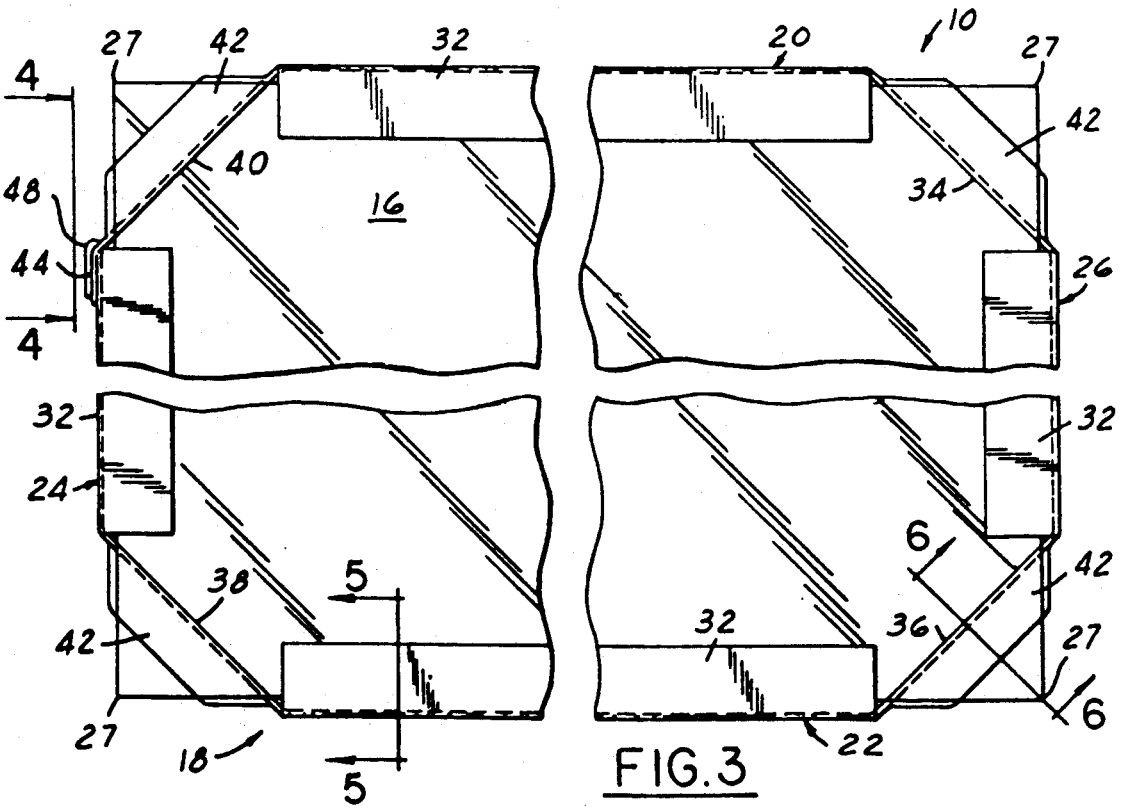
FIG. 3 is a front view of the window unit with parts broken away.
Figure 4:
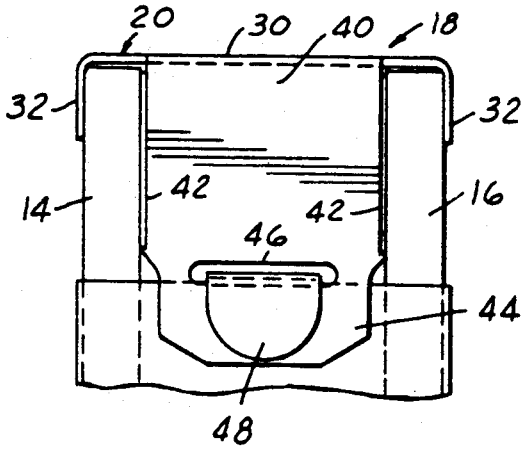
FIG. 4 is a view taken on the line 4—4 in FIG. 3.
Figure 5:
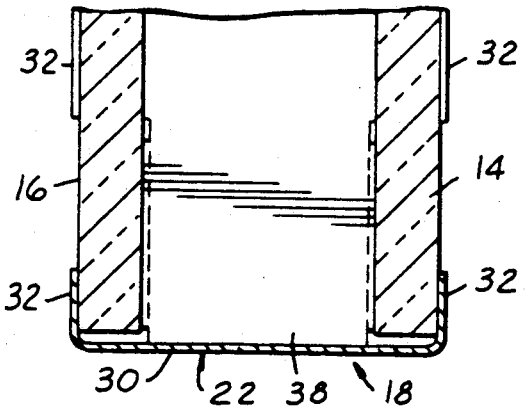
FIG. 5 is a sectional view taken on the line 5—5 in FIG. 3.
Figure 6:
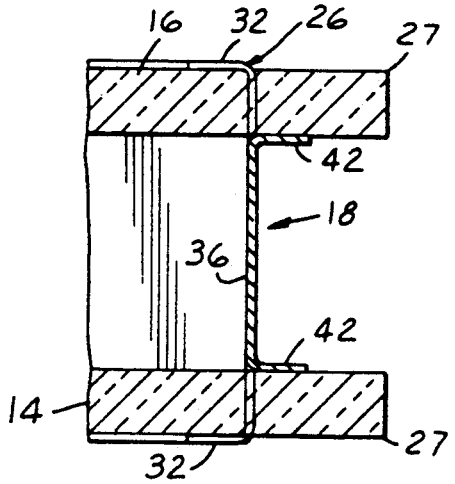
FIG. 6 is a sectional view taken on the line 6—6 in FIG. 3.
Figure 7:
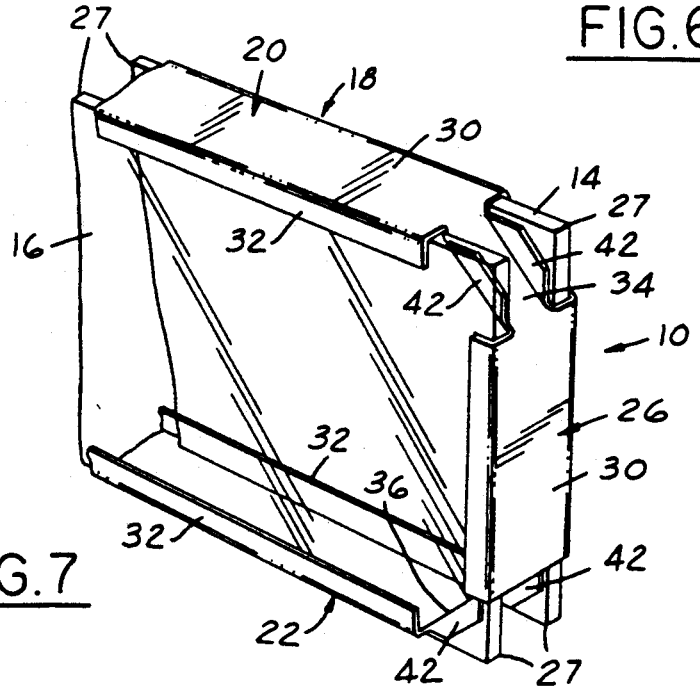
FIG. 7 is a perspective view of a portion of the window unit.

Referring now more particularly to the drawings, there is shown a multi-pane window unit 10 mounted by any suitable means in the window opening of an oven door 12. The window unit 10 comprises a pair of rectangular window panels or panes 14 and 16 of glass or like transparent or translucent material, and a frame 18.

The panels 14 and 16 are of identical size and shape and are disposed in spaced parallel planes, one behind the other. The top and bottom edges of the two panels are respectively in opposed parallel relation to one another, as are the right and left side edges thereof.

The frame 18 is made of a one-piece strip of metal or like flexible, bendable material.

The frame has a channel-shaped clamping section 20 along the top edges of the panels 14 and 16. The frame has similar channel-shaped clamping sections 22, 24 and 26 along the bottom edges and side edges of the panels. All of the channel-shaped clamping sections terminate short of the corners 27 of the panels so that the corners are exposed.

Each channel-shaped section has a base 30 extending across the opposed panel edges, and flanges 32 extending over the outer faces of the panels to hold the panels together.

At the four corners of the window unit, the frame has spacers 34, 36, 38 and 40 extending between the panels and connected at their ends to the ends of the bases 30 of adjacent clamping sections The spacers hold the panels spaced apart. The spacers preferably extend at a 45° angle across the corners of the window unit, so that the spacers actually form an angle of 135° with the bases of the channel-shaped sections to which they are connected.

Each spacer is channel-shaped, having flanges 42 along the opposite edges which are turned outwardly and engage the inner faces of the panels 14 and 16 in surface-to-surface relation.

The spacers 34, 36 and 38 have their ends integrally connected to the bases of both adjacent clamping sections. The fourth spacer 40 is integrally connected at one end to the base of one of the adjacent clamping sections, namely clamping section 20. Its other end has an extension 44 provided with an opening 46 to receive a tab 48 on the end of the base of the other adjacent clamping section 24.

The frame is initially formed as a straight, linear member with clamping section 24 at one end and spacer 40 at the other end.

To assemble the parts of the window unit, the panels 14 and 16 are held in spaced apart parallel relation and the one-piece frame 18 is bent and wrapped around the panels so that the clamping sections 20–26 engage the opposed edges as shown, and the spacers 34–40 extend across the corners of the panels. The ends of the frame come together at one of the corners where the spacer 40 is positioned to receive the tab 48 on one end of the clamping section 24. The tab is extended through the opening 46 in the extension 44 of spacer 40 and folded back to form a releasable connection and complete the assembly. The bases 30 of the clamping sections are flat enabling mounting clips or other components to be attached as desired.

What is claimed is:

1. A window unit for an oven door comprising at least two substantially rectangular window panels, and a frame for holding said panels in laterally spaced, parallel planes with the side and end edges of each panel respectively parallel and opposed to the side and end edges of the other to provide two pairs of opposed side edges and two pairs of opposed end edges, said frame having a U-shaped clamping section along each pair of opposed edges with the ends thereof terminating short of the corners of said panels so that said corners are exposed, each U-shaped clamping section having a base extending across and engageable with a pair of opposed panel edges and flanges extending over and engageable with the outer faces of said panels to hold said panels together, said frame having adjacent each corner of said panels a spacer extending between said panels and connected to said ends of the bases of adjacent clamping sections and engageable with the inner opposed faces of said panels to hold said panels apart, said base of each clamping section being substantially flat and extending from one of hte flanges thereof to the other, said clamping sections being free of contact with the inner opposed faces of said panels.

2. The window unit defined in claim 1, wherein said frame is one-piece member extending about the periphery of said panels.

3. The window unit defined in claim 1, wherein each spacer is channel spaced, having flanges along the opposite edges thereof engaging the inner faces of said panels in surface-to-surface relation.

4. The window unit defined in claim 1, wherein said spacers are spaced inwardly of said corners and extend across said corners at an angle of approximately 45°.

5. A window unit for an oven door comprising at least two substantially rectangular window panels, and a frame for holding said panels in laterally spaced, parallel planes with the side and end edges of each panel respectively parallel and opposed to the side and end edges of the other to provide two pairs of opposed side edges and two pairs of opposed end edges, said frame being in the form of an elongated, one piece strip of flexible, bendable material extending about the periphery of said panels with the ends thereof adjacent one another, means securing said ends of said frame together, said frame having a U-shaped clamping section along each pair of opposed edges with the ends thereof terminating short of the corners of said panels so that said corners are exposed, each U-shaped clamping section having a base extending across and engageable with a pair of opposed panel edges and flanges extending over and engageable with the outer faces of said panels to hold said panels together, said frame having adjacent each corner of said panels a spacer extending between said panels and connected at its ends to said ends of the bases of adjacent clamping sections and engageable with the inner opposed faces of said panels to hold said panels apart, said base of each clamping section being substantially flat and extending from one of the flanges thereof to the other, said clamping sections being free of contact with the inner opposed faces of said panels.

6. The window unit defined in claim 5, wherein each spacer is channel shaped, having flanges along the opposite edges thereof engaging the inner faces of said panels in surface-to-surface relation.

7. The window unit defined in claim 6, wherein said spacers are spaced inwardly of said corners and extend across said corners at an angle of approximately 45°.

8. The window unit defined in claim 7, wherein said means connecting said ends of said frame together comprises releasably interengaged, integral portions of said frame.

9. The window unit defined in claim 8, wherein one end of one of said clamping sections constitutes one end of said frame and one end of one of said spacers constitutes the other end of said frame.

* * * * *